United States Patent [19]

Pfeifer et al.

[11] 4,225,766

[45] Sep. 30, 1980

[54] TOUCH CONTACT

[75] Inventors: Rolf Pfeifer, Erlangen; Jörn Wimmer, Nuremberg, both of Fed. Rep. of Germany

[73] Assignee: Siemens Aktiengesellschaft, Berlin & Munich, Fed. Rep. of Germany

[21] Appl. No.: 9,166

[22] Filed: Feb. 5, 1979

[30] Foreign Application Priority Data

May 18, 1978 [DE] Fed. Rep. of Germany ..... 7814996

[51] Int. Cl.[2] ..... H01H 9/00

[52] U.S. Cl. ..... 200/314; 116/202

[58] Field of Search ..... 200/314, 311, 292, 330, 200/DIG. 47; 116/202, 275, DIG. 5, DIG. 28

[56] References Cited

U.S. PATENT DOCUMENTS

| | | | |
|---|---|---|---|
| 3,440,426 | 4/1969 | Murphy et al. | 200/314 X |
| 3,601,567 | 8/1971 | Shah | 200/314 |
| 3,619,591 | 11/1971 | Korski | 240/2 |
| 3,767,879 | 10/1973 | Nicol | 200/314 |
| 3,811,025 | 5/1974 | Bach | 200/317 |
| 4,071,726 | 1/1978 | Werda | 116/202 X |
| 4,104,981 | 8/1978 | Ono et al. | 116/202 |

FOREIGN PATENT DOCUMENTS

| | | | |
|---|---|---|---|
| 1081958 | 3/1960 | Fed. Rep. of Germany . | |
| 2142884 | 3/1973 | Fed. Rep. of Germany . | |
| 2741492 | 3/1979 | Fed. Rep. of Germany . | |
| 2379896 | 10/1978 | France | 200/DIG. 47 |
| 1002157 | 8/1965 | United Kingdom . | |

*Primary Examiner*—Steven M. Pollard

*Attorney, Agent, or Firm*—Hill, Van Santen, Steadman, Chiara & Simpson

[57] ABSTRACT

A manually actuatable sliding short-stroke switch is provided with a light conducting cap attached to the sliding piece and a touch surface above the cap. A means for illuminating the touch surface is provided, and the light conducting cap is covered on its surface with a layer impermeable to light except for a selected area of the touch surface and a light instance area for receiving light from the source. The light conducting cap and the touch surface provide a means for actuating the switch substantially unaffected by fatigue due to repeated use and which can be illuminated without transferring light to adjacent touch surfaces.

2 Claims, 1 Drawing Figure

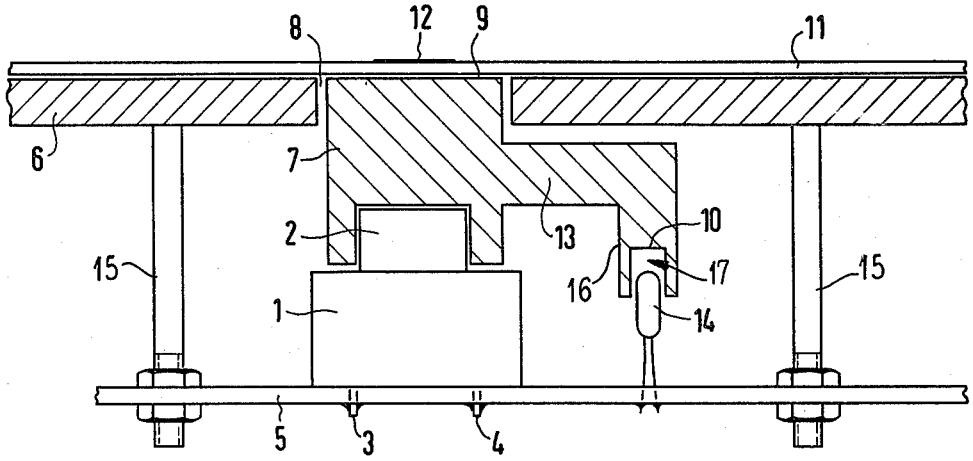
8
12
9
11
6
7
2
13
10
15
16
17
15
1
14
5
3
4

TOUCH CONTACT

BACKGROUND OF THE INVENTION

1. Field of the Invention

This invention relates to an illuminatable touch contact and means for illuminating same for use with a manually actuatable short stroke sliding switch or key.

2. Description of the Prior Art

Use of so-called foil surface keys is known in the art to provide a flat operating surface in a field or bank with a plurality of touch contacts. Foil surface keys have a thin foil layer having a contact aperture which is sandwiched between two outer foil layers having metallic tracks. At an area aligned with the contact aperture, the tracks on the outer foil layers may be annular or planar. When the upper foil layer is lightly pressed against the lower, the interval between the outer layers is overcome and the contact is closed when the tracks meet at the contact aperture. The pressure required to make the contact is determined by the thickness of the intermediate foil. Upon release of the upper foil layer, that layer returns to its initial position because of its inherent elasticity and tension and the contact is again open. A switching symbol may be imprinted on the upper layer of foil, designating the function of the switch.

Foil surface keys such as the type described above have the disadvantage of a short life due to fatigue resulting from frequent actuation. When such fatigue occurs, the upper foil layer no longer returns to its initial position, resulting in a permanent contact. When such a permanent contact occurs, the entire control panel or bank of switches must be replaced, because the replacement of individual contacts is not possible in such a control panel configuration. Further, the tracks on the outer foil layers themselves may become brittle, resulting in intermittent circuits or complete failure.

Finally, space limitations make illumination from below of the switching symbol on the upper foil layer difficult and expensive.

SUMMARY OF THE INVENTION

A short stroke manually actuatable switch or key is provided with a light conducting cap which is attached to the sliding piece of the switch, and which extends a distance upwardly therefrom. The cap extends into a correlated opening in a control panel so that its upper surface lies approximately in the same plane as the panel. The entire surface of the control panel, including the cap, is covered with an elastic foil. Pressure at designated portions of the foil immediately above the cap actuates the switch to which the cap is attached. A symbol designating the switch function may be imprinted on the foil.

The light conducting cap has a lateral arm which extends generally laterally from the switch below the control panel surface. The arm has a downwardly extending portion which encases a light source such as a light emitting diode. Portions of the light conducting cap surrounding the light source and immediately below the foil layer admit and radiate light from the light source to the symbol. The remainder of the outer surface of the light conducting cap is covered with an opaque paint or other substance so that areas adjacent the switch are not illuminated.

It is an object of the present invention to provide a touch contact which allows a control panel to be constructed of a plurality of such contacts which are individually replaceable and which may be individually illuminated without illuminating adjacent switches.

It is a further object of the present invention to provide a touch contact switch having a minimum of parts which are subject to fatigue due to repeated use thereby providing a switch with a long and reliable lifetime.

BRIEF DESCRIPTION OF THE DRAWING

FIG. 1 shows a side view, partially in section, of a switch and touch contact therefor mounted below a control panel.

DESCRIPTION OF THE PREFERRED EMBODIMENTS

As shown in FIG. 1 a short stroke manually actuatable key or switch has a sliding piece 2 which is movable to actuate the switch. The key 1 is mounted on a printed circuit board 5 at terminals 3 and 4 by any suitable means such as soldering.

A cover plate 6 for a control panel is mounted a distance above the circuit board 5 and maintained a fixed distance therefrom by mounting means such as the bolt and sleeve shown at 15.

A light conducting cap 7, which may be made of a material such as plexiglass, is attached to the sliding piece 2 and extends into an opening 8 in the cover plate 6. The light conducting cap 7 has an upper flat surface 9 which is generally co-planar with the top of the cover plate 6. The entire control panel, including the upper surface 9 of the cap 7 is covered with an elastic foil 11. The foil 11 may have a character or symbol 12 imprinted thereon to designate the function of the switch disposed directly beneath the symbol 12.

The elastic foil 11 is of sufficient elasticity to be depressed a distance sufficient to actuate the switch or key 1 and return to its initial position without damage thereto.

The light conducting cap 7 has a lateral arm 13 which extends a distance away from the switch 1, and terminates in a downwardly extending portion 16. The downwardly extending portion 16 terminates in a receptacle 17. The receptacle 17 is of sufficient size to receive a light source 14, which may be a miniature incandescent bulb, a light emitting diode, or any other suitable source of visible light. The light source 14 is mounted in the circuit board 5 by any suitable means such as soldering. The receptacle 17 has a top surface 10 which admits light from the light source 14. The remainder of the outer surface of the light conducting cap 7 is coated with an opaque substance with the exception of the upper flat surface 9. Light admitted through the surface 10 is thus radiated from the cap 7 only at the upper surface 9. No light escapes from the light conducting cap to erroneously illuminate adjacent switch symbols to misinform a viewer as to which switches have or have not been actuated. The light source 14 may be connected by suitable circuitry (not shown) to the switch 1 to be normally on or normally off when the switch 1 is in a designated state.

The construction of the switch and light conducting cap 7 is such that a plurality of touch contacts may be arranged in a bank on an operating panel in close proximity without danger of erroneous readings.

Because the foil layer 11 is the only continuously depressed part which is relatively susceptible to fatigue, a reliable means for operating a short stroke switch or key having a long life is provided. Should portions of the foil layer 11 become fatigued so that replacement of the layer is necessary, the layer 11 need simply be removed and replaced with another, without disturbing the cap 7 or the switch 1. It is presumed that the use of each switch or key in a bank of a control panel will be of approximately equal frequency, so that replacement of the foil layer 11 because of fatigue associated with a single switch will generally not be necessary. In addition, if fatigue of the foil layer 11 does occur, it will not result in a permanent or intermittent contact being made, and will therefore not impair circuit operation in any way.

Instead of a short stroke key, a microswitch with a snap effect can also be utilized in connection with the light conducting cap 7. When such a microswitch is used, the user upon actuation receives an acoustic and tactile acknowledgement of actuation in addition to an optical reply from the light source 14.

The switch 1 may also be utilized without the foil layer 11 covering the cover plate 6, however, the foil layer 11 provides a covering to prevent dust and other particles from entering the opening 8 which may impair operation of the switch 1 or other associated circuitry.

Although various modifications and changes may be apparent to those skilled in the art, it is the intention of the inventors to include within the patent warranted hereon all such changes and modifications as may reasonably and properly be considered within the scope of applicants' contribution to the art.

We claim as our invention:

1. A light conducting cap for use with a short stroke switch mounted beneath a control panel, said cap having a light transmissible touch surface;

a laterally extending arm terminating in a downwardly extending portion having a receptacle at a bottom thereof;

a light admissible surface forming a wall of said receptacle;

an engagement area for engaging a movable actuator for said switch for co-action of said cap and said actuator; and an opaque outer surface to prevent external radiation when a light source received in said receptacle transmits light through said light admissible surface to said touch surface.

2. A touch contact comprising:

a short stroke manually actuatable switch mounted beneath a control panel and having a vertically slidable actuator;

a cap comprised of light conducting material mounted above said actuator for co-action therewith, said cap having a top which extends into an aperture in said control panel for guided vertical action above said switch and which terminates substantially co-planar with said panel, said cap having a light transmissible surface co-planar with said top, said cap having a laterally extending arm having a downwardly extending portion terminating in a receptacle for receiving said light source, and a light admissible surface forming a wall of said receptacle;

a light source adjacent said light admissible surface for selectively illuminating said top of said cap.

* * * * *